United States Patent [19]

Jones et al.

[11] Patent Number: 4,482,279

[45] Date of Patent: Nov. 13, 1984

[54] BINDING MACHINES

[75] Inventors: Leonard W. N. Jones, Camberley; Samuel D. Kandlekar, Woking; Derek J. Archer, Reigate, all of England

[73] Assignee: James Burn Bindings Limited, Surrey, England

[21] Appl. No.: 354,759

[22] Filed: Mar. 4, 1982

[30] Foreign Application Priority Data

Apr. 14, 1981 [GB] United Kingdom ..... 8111828

[51] Int. Cl.[3] ..... B42G 11/02

[52] U.S. Cl. ..... 412/39

[58] Field of Search ..... 402/12, 19, 20, 57; 412/33, 38, 39, 34

[56] References Cited

U.S. PATENT DOCUMENTS

| | | | |
|---|---|---|---|
| 3,334,918 | 8/1967 | Pigna et al. | 412/39 |
| 3,451,081 | 6/1969 | Liouville | 412/39 |
| 3,474,593 | 10/1969 | Hartbauer et al. | 412/34 |
| 3,479,676 | 11/1969 | Morris | 412/34 |
| 3,760,444 | 9/1973 | McNichol | 412/34 |
| 3,883,916 | 5/1975 | Adams | 412/39 |
| 4,031,585 | 6/1977 | Adams | 412/39 |
| 4,149,289 | 4/1979 | Sahlin | 412/33 |
| 4,208,750 | 6/1980 | Pfaffle | 412/34 |

*Primary Examiner*—R. L. Spruill
*Assistant Examiner*—Paul M. Heyrana
*Attorney, Agent, or Firm*—Wood, Herron & Evans

[57] ABSTRACT

A binding machine for binding packets of perforated sheets together by means of binding elements, the elements being formed with prongs which are bent together by jaws into the perforations to bind the sheets, a carrier bar part of which is magnetised holds each element between the jaws while stops project from the bar to engage with the back of each packet to assist in accurately locating perforations in the packets with the prongs of the elements as they are bent together by the jaws.

7 Claims, 3 Drawing Figures

BINDING MACHINES

The present invention relates to machines for binding packets of perforated sheets to book form with wire binding elements each formed from a length of metal wire bent to form a series of curved hairpin-shaped prongs on which the sheets are impaled and which are brought to ring shape by bringing their closed ends or "points" into the vicinity of their open ends or "roots". Such machines will be referred to herein as "binding machines of the kind set forth".

In our G.B. Pat. No. 1,460,444 (the disclosure of which is incorporated herein by reference) there is shown a binding machine of the kind set forth. In this machine wire binding elements are transferred to a binding station by means of a carrier bar having magnetic elements, perforated packets of sheets are fed to the binding station and the binding elements are then closed through the perforations by a pair of closing tools to complete the binding operation. During the binding operation the packets are clamped in position so that the perforations align with the binding elements as they close. Whilst this clamping for alignment of the perforations works well under most conditions, when large packets are being bound the aligned perforations which are aligned in a straight line tend to distort the binding elements which are being formed in a curvilinear shape.

According to the present invention there is provided a binding machine of the kind set forth having a binding element carrier bar at least partly magnetised to hold a binding element, the bar having an element carrying surface and a plurality of stop members protruding from the carrying surface to engage with a packet to be bound and to align the packet and the perforations in the packet with the open "points" of the element.

In the binding operation the packets are manually fed so as to engage with the stop members and the packets are not clamped. In the final binding operation the element is closed through the perforations, the sheets of the packet being free to take up the curvilinear form of the closed element which prevents distortion of the element.

Preferably the carrier bar is formed as a comb with teeth corresponding with gaps in the element. The teeth maintain the element in correspondence with the perforations in the packet.

In an embodiment of the present invention the stop members protrude through gaps in the comb each stop member corresponding to a tooth position so that the stop members engage with the packet between gaps in the element.

Figure 1:
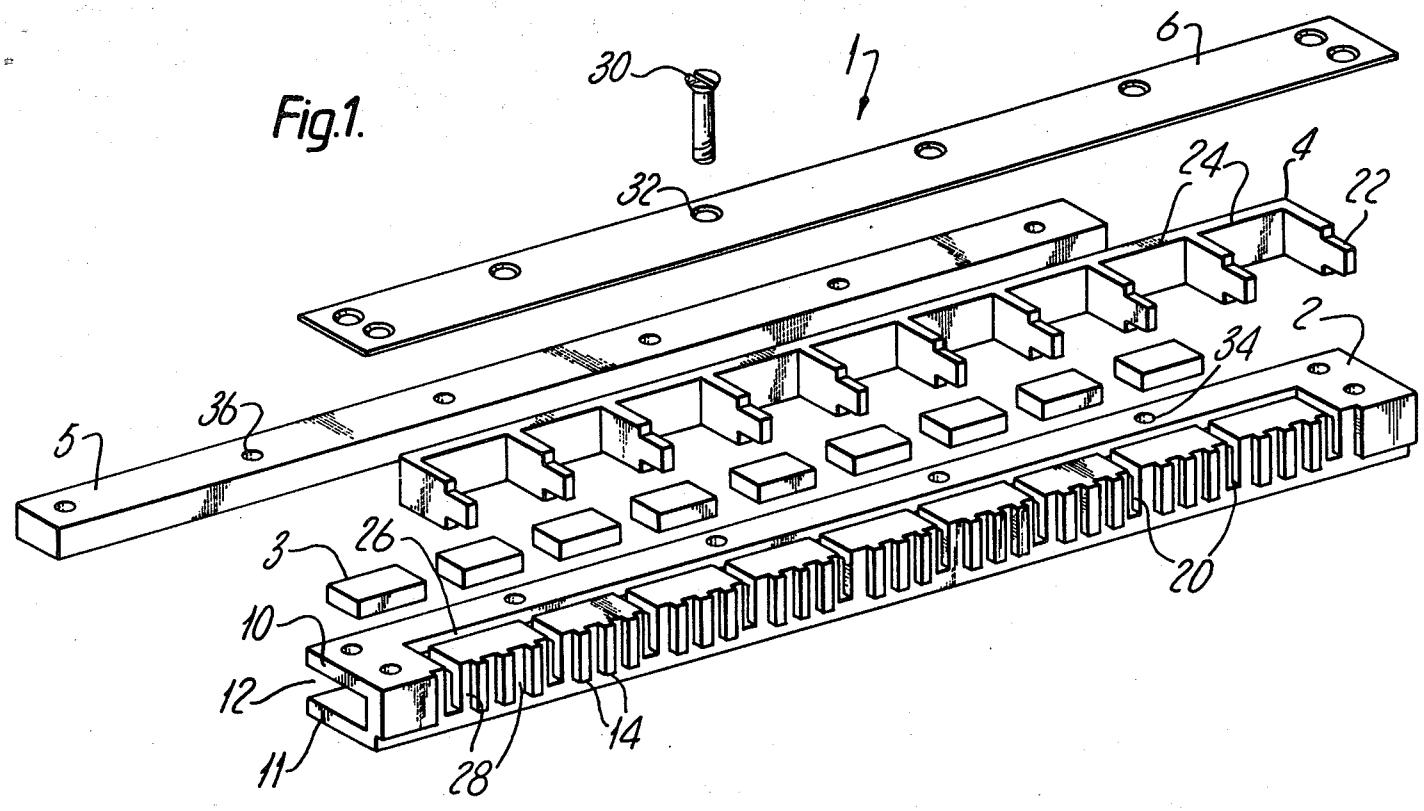
Figure 2:
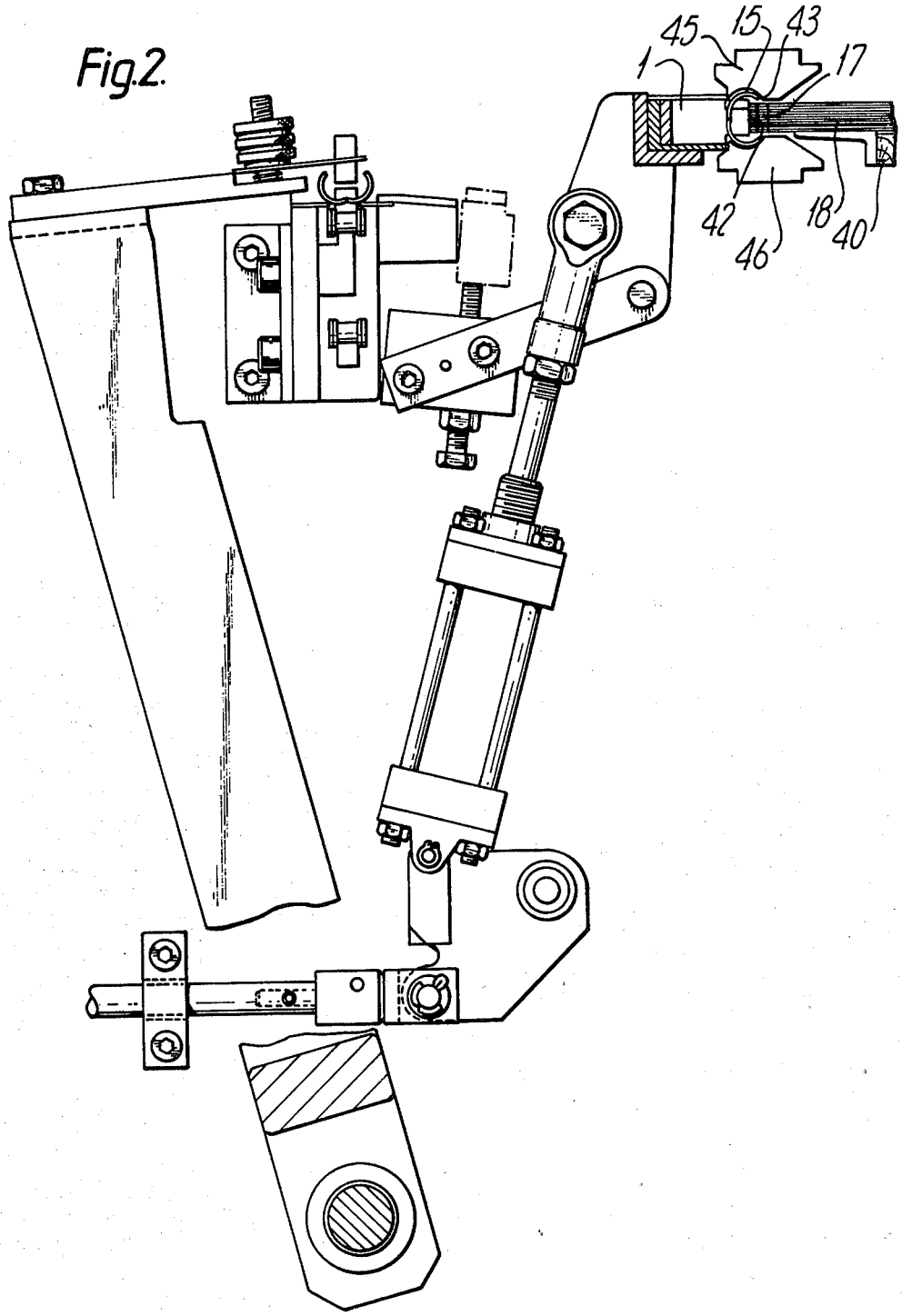
Figure 3:
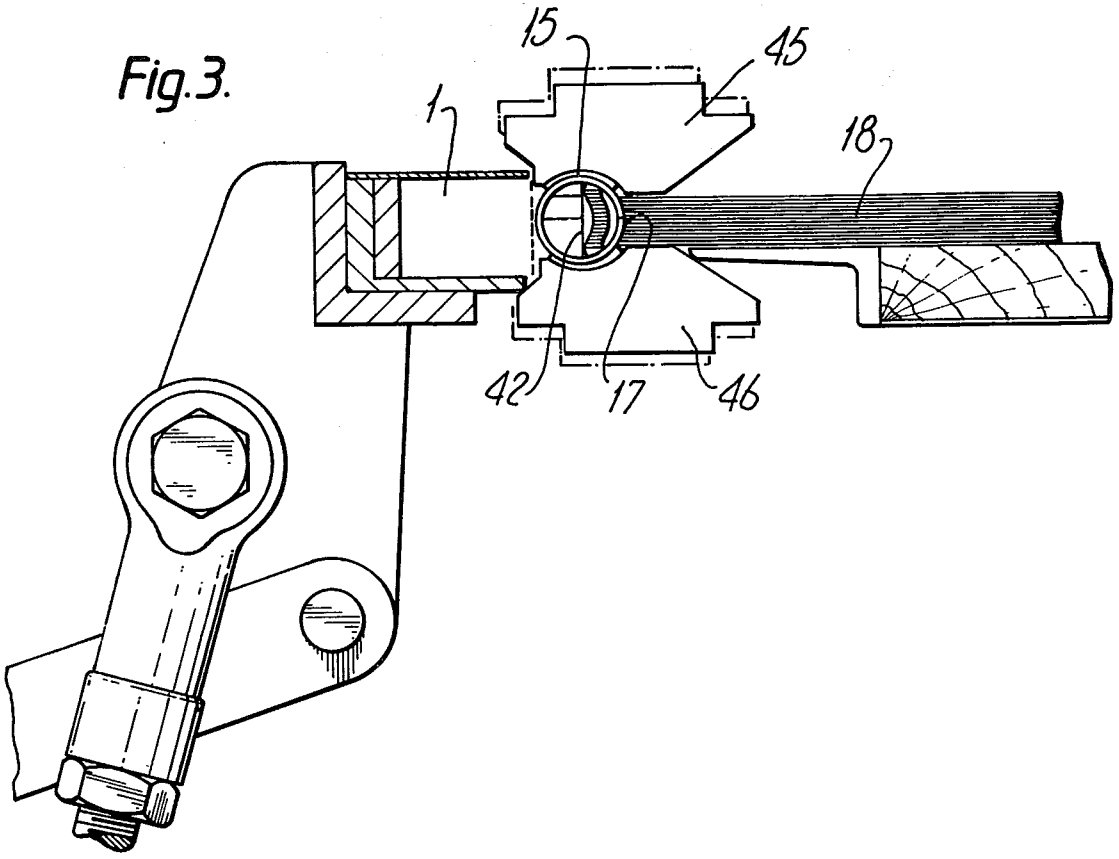

An embodiment of the invention will now be described by way of example with reference to the accompanying drawings in which:

FIG. 1 is a perspective exploded view of the carrier bar for a binding machine according to the invention, FIG. 2 is a side elevation of the binding machine of the invention incorporating the carrier bar of FIG. 1, and FIG. 3 shows the carrier bar of the machine of FIG. 2 with a binding element in the formed state.

In FIG. 1 there is shown a carrier bar 1 comprising a magnet bar 2, nine magnets 3, a bookstop insert 4, a packer bar 5 and a top cover plate 6.

The magnet bar 2 is formed with a generally U-shaped cross section, the arms 10 and 11 defining a U-shaped hollow 12. On the front of the bar which is formed as a comb there are teeth 14 which correspond with gaps in the binding element 15 (See FIG. 2). The teeth 14 maintain the element 15 in correspondence with perforations 17 in the packet of sheets 18. In the position of every fourth tooth a gap 20 is formed in the bar 2 which receives one of the book stops 22 which approach from a connecting portion 24 of the insert 4. The connecting portion fits into a lateral groove 26 which runs most of the length of the bar 2 behind tooth mounting portions 28 on the front of which the teeth 14 are formed. The U-shaped hollow 12 extends the length of the bar 2 through the tooth mounting portions 28 so that each magnet 3 can be located within each tooth mounting portion 28 and these magnets are secured within each tooth mounting portion by small screws (not shown).

In order to stiffen the magnet bar which is formed of brass the heavy brass packer bar 5 is secured by means of screws 30 which pass down through holes 32 in the brass cover plate 6, holes 34 in the top arm 10 of the bar 2 and holes 36 in the packer bar 5, engaging in threaded holes (not shown in the lower arm 11 of the magnet bar 2). The insert 4 is formed of non-magnetic stainless steel.

In operation the perforated packet of sheets 18 (see FIG. 2) is manually fed across the surface of table 40 so that its inner edge 42 locates against the outer edges of book stops 22. The book is laterally guided by an adjustable guide (not shown) so that the holes or perforations 17 in the packet are aligned with the points 43 of the binding element 15. The jaws 45 and 46 are closed to close the binding element so that the binding element in cross section is circular. The binding element when closed may push the centre sheets of the packet away from the book inserts so that the holes 17 are deformed into the corresponding shape of the binding elements which are enabled to assume their correct circular shape without distortion by the packet of sheets which is freely placed on the table 40.

I claim:

1. In a binding machine for binding a packet of perforated sheets together with a wire binding element, said element being formed from a length of ferrous metal wire bent to form a series of curved hairpin-shaped prongs with gaps in between, and said element being adapted to receive said sheets in impaled relation prior to closing said element into binding relation with said packet, the improvement comprising a set of jaws movable relative one to the other for closing said binding element into binding relation with said packet, a magnet bar located adjacent said jaws, said magnet bar being at least partly magnetized for holding said binding element in position between said jaws prior to closing said element into binding relation with said packet, said magnet bar having a plurality of longitudinally spaced openings along one face thereof, a plurality of spaced stop members spaced along said one face of said magnet bar and extending from said one face thereof, said stop members protruding outwardly of said one face of said magnet bar through said openings so that free ends of said stop members are spaced from said magnet bar, said stop member free ends being adapted to engage the edges of said sheets along one edge of said packet for aligning the perforations of said sheets relative to the prongs of said binding element prior to said element being closed into binding relation with said packet and for maintaining alignment of at least a portion of said sheets as said element is closed into binding relation with said packet, and a packet supporting table located adjacent said jaws, said table being adapted to position a packet of sheets in binding position between said jaws.

2. An improvement as set forth in claim 1 said magnet bar comprising a series of groups of teeth on said one face, said teeth being adapted to project into gaps between said binding element's prongs for holding said prongs in alignment with said perforations in said sheets, and said stop members protruding outwardly beyond said teeth.

3. An improvement as set forth in claim 2 in which a stop member protrudes outwardly between adjacent groups of said teeth.

4. An improvement as set forth in claim 3, said magnet bar comprising a set of arms extending away from said jaws, said arms defining a hollow therebetween, and a magnetic element mounted behind each group of teeth in said hollow along the length of said magnet bar.

5. An improvement as set forth in claim 4, said improvement comprising an insert member that mounts said stop members, said insert member cooperating with said magnet bar to retain said magnetic elements in said bar's hollow.

6. An improvement as set forth in claim 5, said improvement comprising a strengthening bar located in said magnet bar's hollow behind said insert member.

7. An improvement as set forth in claim 3, said stop members being formed from a non-magnetic material.

* * * * *